US008134892B2

(12) United States Patent
Danthe et al.

(10) Patent No.: US 8,134,892 B2
(45) Date of Patent: Mar. 13, 2012

(54) TIMEPIECE WITH MODULAR DISPLAY

(75) Inventors: Anouk Danthe, Denens (CH); Olivier Leu, Denens (CH); Willy Meier, Fontaines (CH); Sébastien Brancucci, Cormondrèche (CH)

(73) Assignee: Creations Horlogeres de Lully SA, Lully (CH)

( * ) Notice: Subject to any disclaimer, the term of this patent is extended or adjusted under 35 U.S.C. 154(b) by 184 days.

(21) Appl. No.: 12/674,740

(22) PCT Filed: Aug. 29, 2008

(86) PCT No.: PCT/EP2008/061353

§ 371 (c)(1),
(2), (4) Date: Apr. 14, 2010

(87) PCT Pub. No.: WO2009/027490

PCT Pub. Date: Mar. 5, 2009

(65) Prior Publication Data

US 2011/0044138 A1 Feb. 24, 2011

(30) Foreign Application Priority Data

Aug. 29, 2007 (EP) ..... 07115194

(51) Int. Cl.
*G04B 25/00* (2006.01)
*G04B 19/04* (2006.01)
*G04C 19/00* (2006.01)

(52) U.S. Cl. ..... 368/223; 368/224; 368/232; 368/283

(58) Field of Classification Search ..... 368/76, 368/79, 80, 82, 84, 223, 224, 228, 232, 233, 368/283

See application file for complete search history.

(56) References Cited

U.S. PATENT DOCUMENTS

| | | | | |
|---|---|---|---|---|
| 4,488,818 | A | 12/1984 | Saurer et al. | |
| 4,982,388 | A | 1/1991 | Erard | |
| 5,202,858 | A * | 4/1993 | Kanzaki | 368/71 |
| 5,740,130 | A | 4/1998 | Grupp et al. | |
| 6,671,231 | B2 * | 12/2003 | Gilomen | 368/80 |

(Continued)

FOREIGN PATENT DOCUMENTS

EP 0 078 237 A1 5/1983

(Continued)

OTHER PUBLICATIONS

International Search Report, dated Jan. 28, 2009, from corresponding PCT application.

(Continued)

*Primary Examiner* — Vit Miska
(74) *Attorney, Agent, or Firm* — Young & Thompson

(57) ABSTRACT

A timepiece includes: a housing (10), a movement (12) provided in the housing, a piece of glass (14) closing the housing, a dial (60) provided between the movement and the glass, wherein the dial can assume a first state in which the elements located behind the dial opposite the glass are visible from the glass side and a second state in which the elements are hidden, a mobile part capable of movement between at least one first position and at least one second position respectively corresponding to the first and second states of the dial, and display members (16) provided between the dial and the glass. The timepiece further includes a lid movably mounted relative to the housing and kinematically connected to the mobile part for urging the same from the first to the second position.

21 Claims, 4 Drawing Sheets

U.S. PATENT DOCUMENTS

| | | | | |
|---|---|---|---|---|
| 6,903,784 | B1 * | 6/2005 | Basturk | 349/2 |
| 7,137,733 | B2 * | 11/2006 | Suzuki | 368/316 |
| 2002/0064100 | A1 * | 5/2002 | Della Santa | 368/283 |

FOREIGN PATENT DOCUMENTS

| | | | |
|---|---|---|---|
| EP | 0 310 007 | A1 | 4/1989 |
| EP | 0 484 821 | A2 | 5/1992 |
| EP | 0 786 685 | A1 | 7/1997 |
| EP | 1 033 605 | A1 | 9/2000 |
| EP | 1 389 411 | A1 | 2/2004 |
| FR | 2 514 520 | A3 | 4/1983 |
| GB | 2 090 440 | A | 7/1982 |
| JP | 57-079481 | A | 5/1982 |

OTHER PUBLICATIONS

European Search Report, dated Feb. 8, 2008, from corresponding European application.

* cited by examiner

TIMEPIECE WITH MODULAR DISPLAY

TECHNICAL FIELD

The present invention relates to the horology field and concerns a timepiece with modular display comprising a case, a movement housed in the case, a crystal closing the case and a dial arranged between the movement and the crystal.

BACKGROUND OF THE INVENTION

The evolution of horology, both mechanical and electronic, leads to offering timepieces capable of displaying a large amount of information or which may, in the eyes of the wearer, offer increasingly sophisticated mechanisms. However, it is not always desirable for all of the information offered by the watch to be displayed continuously, whether out of discretion or to favor reading of the time of certain particular information, which can be made difficult by the multiplication of dials and other indexes.

In order to respond to this problem, it is known, for example from document EP 0 484 821, to have a timepiece as defined above, in which the information to display is not always visible on the dial. More particularly, the presented watch includes hands to display the current time and an LCD screen, to display particular information, connected to an alarm. A mobile plate is arranged so as to cover the LCD display during normal operation of the watch, and to retract when the alarm is triggered, in order to display the particular information.

The present invention aims to improve the type of device presented in the aforementioned document, by adding a particularly original control organ thereto.

Another aim of the invention is to propose another modular display solution which, in particular, does not require forming an opening in the dial, aside from that which may be necessary for the passage of the hands.

BRIEF DESCRIPTION OF THE INVENTION

More precisely, the invention concerns a timepiece with modular display comprising:

- a case,
- a movement housed in the case,
- a crystal closing the case,
- a dial arranged between the movement and the crystal, said dial being capable of assuming a first state in which element situated behind the dial in reference to the crystal are visible from the side of the crystal and a second state in which said elements are hidden,
- a mobile portion capable of moving between at least one first position in which the dial is in its first state, and at least one second position in which the dial is in its second state, and
- display members arranged between the dial and the crystal.

According to the invention, the timepiece also comprises a cover mounted mobile in relation to the case and kinematically connected to the mobile portion to make it go from its first to its second positions.

According to a first embodiment, the mobile portion is part of the dial and the latter is positioned opposite at least one display zone situated between the movement. When the dial is in its first state, it does not allow outside light to pass, at least in said zone, and when the dial is in its second state, it is passed through by the light from outside the watch in the direction of the movement, at least in the zone.

Advantageously, the dial comprises a first glass polarized in a first direction and a second glass polarized in a second direction, one of the two glasses defining the mobile portion. The glasses are arranged such that, when the dial is in its first state, the directions of polarization are oriented perpendicularly and are parallel in the second state.

According to another embodiment, the dial is pierced with an opening and the mobile portion defines a fitting dimensioned and arranged so as to be able to cover the opening.

The timepiece according to the invention can also include one or the other of the following features.

- The cover and the frame are connected kinematically via an endless screw.
- The cover and the frame are, moreover, connected kinematically via a differential arranged so as to reduce the rotation created by the cover and transmitted to the frame.
- The first and second extreme positions of the cover are defined by stops and correspond respectively to the first and second states of the dial.

BRIEF DESCRIPTION OF THE DRAWINGS

Other details of the invention will appear more clearly upon reading the description which follows, done in reference to the appended drawing, in which.

DETAILED DESCRIPTION OF THE INVENTION

Figure 1:
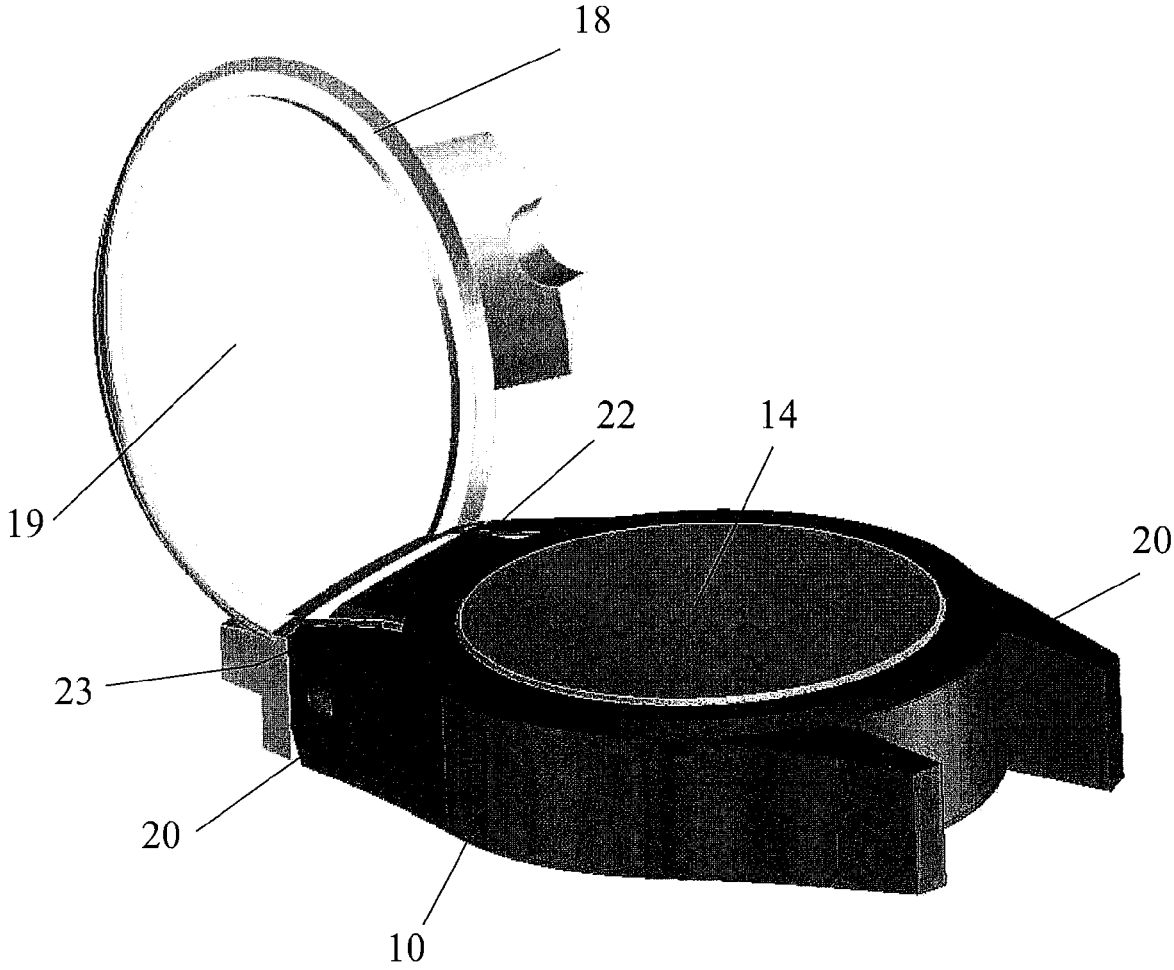
FIG. 1 is a three-dimensional view of a watch according to one preferred embodiment of the invention.
Figure 3:
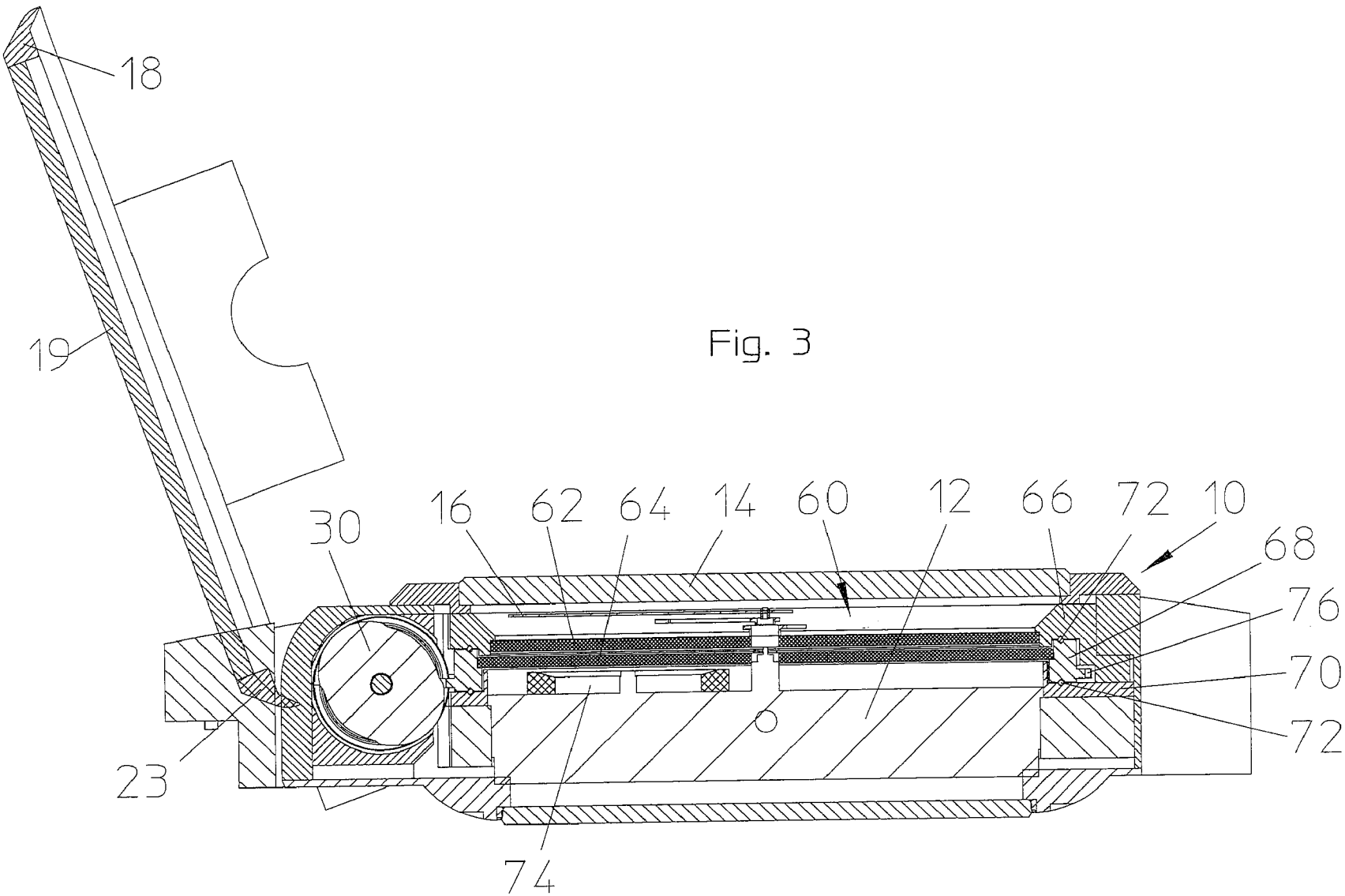

FIG. 1 shows a watch according to one preferred embodiment of the invention. Conventionally, this watch includes a case 10, a movement 12, visible in FIG. 3 and housed in the case, and a crystal 14, closing the case. In this alternative, the movement is of the mechanical or electromechanical type and drives, for the display of the current time, a set of hands 16 arranged under the crystal, so as to be visible for the wearer.

The watch also includes a cover 18 mounted mobile in reference to the case. In the example shown, the cover 18 is articulated on the case 10 along an axis AA so as to superimpose itself on the crystal of the watch when the cover is closed. The latter part receives a crystal 19 so as to leave the hands 16 visible when it is closed. The case is provided with two pairs of horns 20 to receive a bracelet. Preferably, the axis AA is perpendicular to the axis of the bracelet and the articulation is arranged between two horns of a pair. As shown more particularly by FIG. 2, the case 10 extends, at its middle, by a frame 22 defining a housing. The frame is arranged between the horns 20 which receive the articulation of the cover 18. One will note that the bracelet can be attached to the case along an axis parallel to, but not combined with, the axis AA.

The articulation of the cover on the case includes two hinge-pins 23 extending the cover, each being interposed between a horn 20 and the frame 22. The articulation is also made up of two pivot-shanks 24 pivoting respectively in both of the two walls opposite the frame 22 perpendicular to the axis AA. Two joints 26 ensure the sealing and the pivoting of each of the pivot-shanks 24. The latter parts go through the wall of the frame 22 and are fitted, at a first of their ends, in each of the hinge-pins 22 of the cover 18. If necessary, the first elements of the bracelet are fixed between the horns and the hinge-pins.

Figure 2:
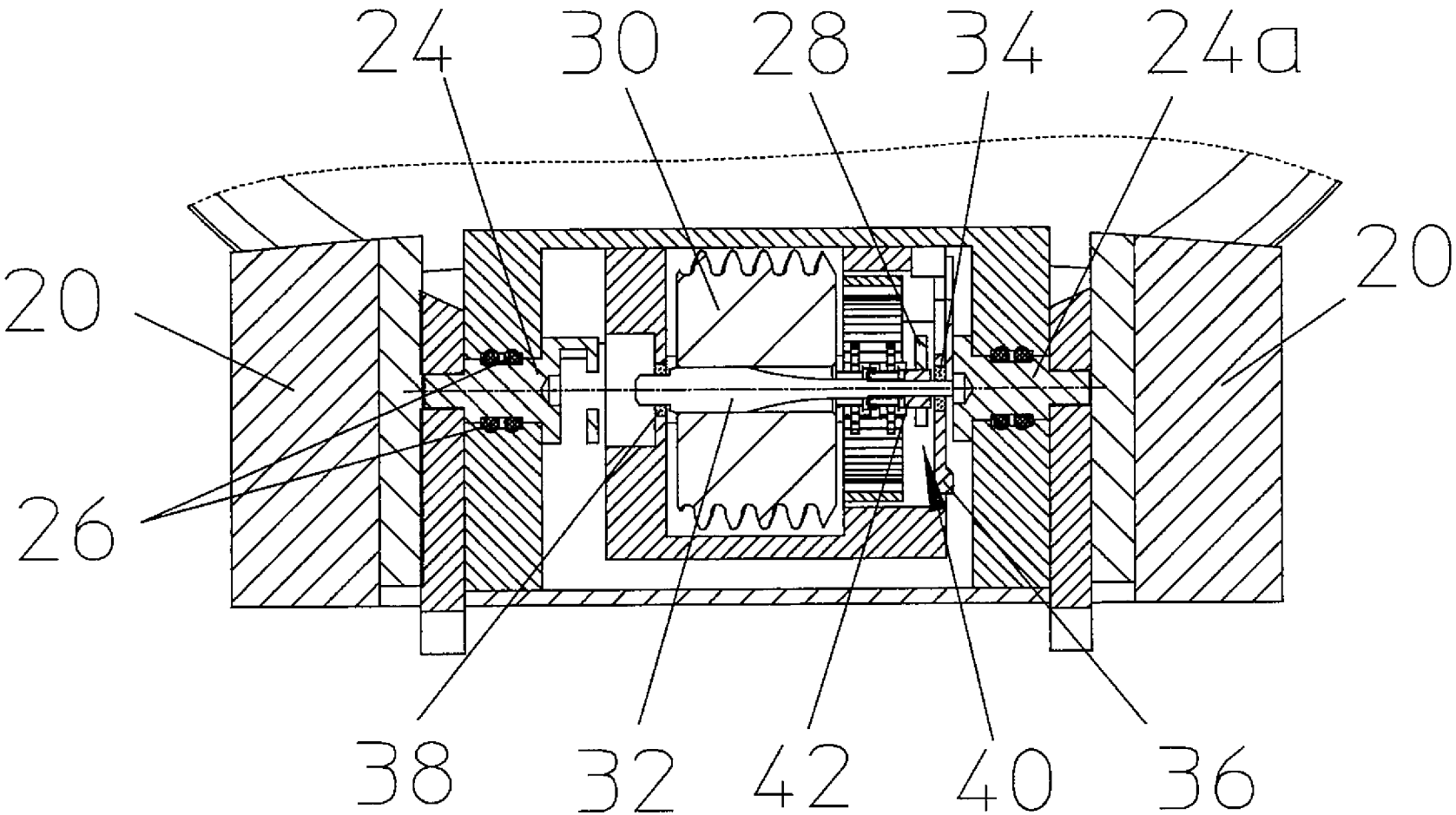
FIGS. 2 and 3 are cross-sectional views along an axis AA and BB, respectively, of the watch of FIG. 1.

As shown particularly by FIG. 2, at least one 24*a* of the pivot-shanks 24 ends, at its second end, with a female square arranged inside the housing. As one skilled in the art understands, a female square 28 is an opening of square shape, arranged perpendicularly in relation to the axis of the pivot-shank, so as to allow a driving in rotation around that axis.

Inside the housing is positioned an endless screw 30, at the center of which an arbor 32 of axis AA forming the hub of the screw 30 is fitted. At a first end, on the side of the pivot-shank 24*a*, the arbor is mounted pivotingly on a stone 34 housed in a bridge 36, integral with the housing. As one will understand later, the bridge is arranged so as to serve as stop for the pivot-shank 24, in order to limit the travel of the cover when it is opened. At its second end, the arbor is mounted pivotingly on a stone 38 housed in a wall of the frame 22. The arbor 32 is therefore free in rotation in relation to the pivot-shank 24*a*.

Figure 4:
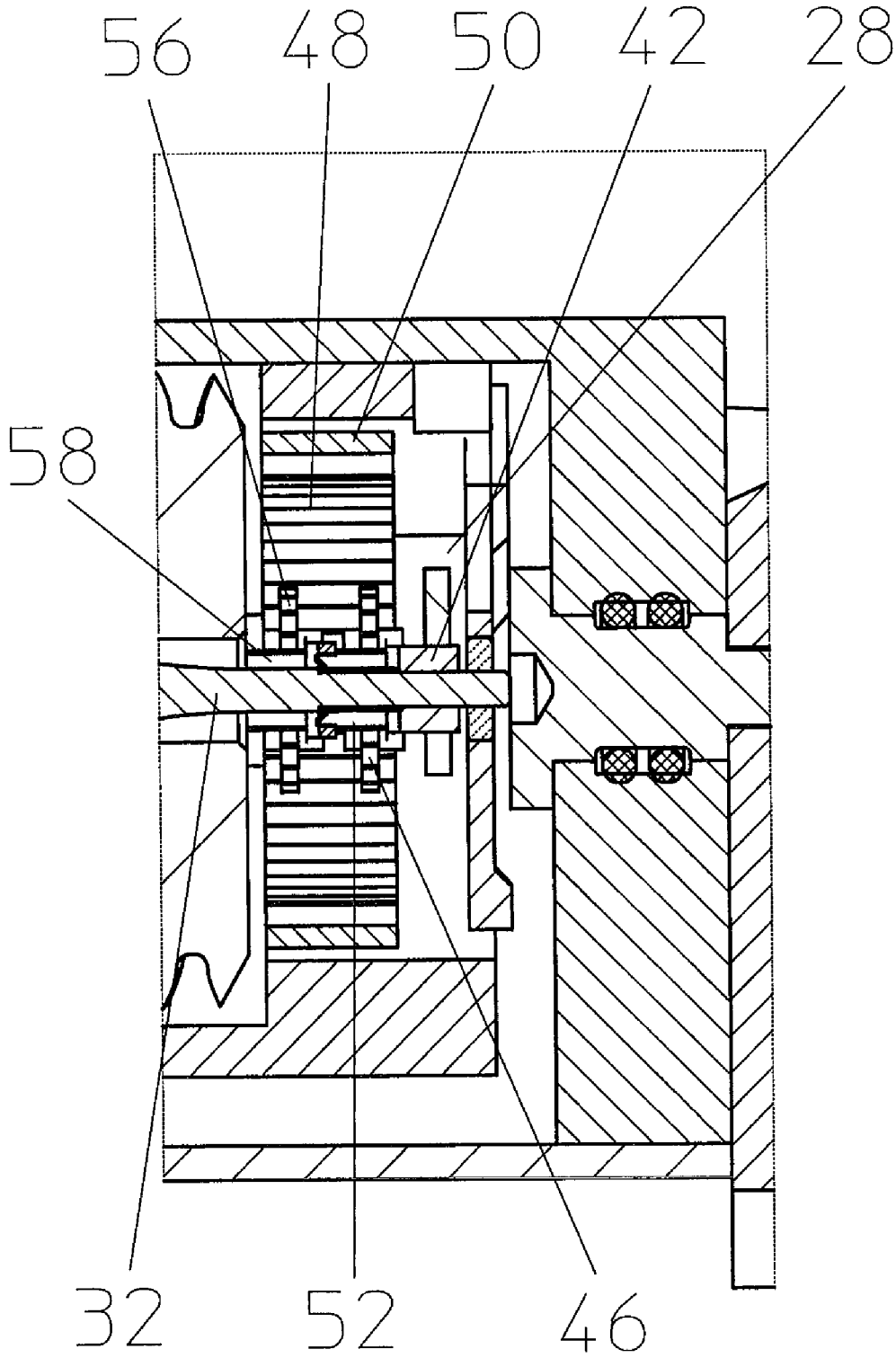
FIG. 4 is a close-up view of the differential.

In order to kinematically connect the cover 18 to the endless screw 30, a differential 40, illustrated in detail in FIG. 4, is arranged between the pivot-shank 24*a* integral in rotation with the cover 18 and the arbor 32 integral with the endless screw 30. This differential 40 aims to transmit the rotation created by the rotation of the cover to the endless screw, by reducing it.

At the entry of this differential, a male square 42 mounted free on the arbor assumes a position inside the female square 28 of the pivot-shank 24*a*, in order to be driven in rotation by the cover 18. This square is integral with a satellite wheel holder, not shown, which drives at least two planetary wheels 46 around the axis AA. The planetary wheels mesh with an inside toothing 48 of a ring 50 integral with the frame. These planetary wheels 46 also mesh with a solar wheel 52, mounted free in rotation on the arbor 32. In order to have a more significant reduction, the differential illustrated as an example is dual. Thus, the solar wheel 52 is integral with a second satellite wheel holder, not shown, which also drives at least two planetary wheels 56 around the axis AA. The planetary wheels 56 mesh with the inside toothing of the ring 50. These planetary wheels also mesh with a second solar wheel 58, integral with the arbor 32. This construction advantageously makes it possible to have a significant gear ratio, with a mechanism taking up little space. It would be possible only to have a simple differential by using the solar wheel 52 as differential exit. In this case, the latter part is integral with the arbor.

One will also note that the diameter of the arbor 32 can advantageously not be constant. More precisely, in order to have a mechanically solid connection between the arbor and the endless screw, the arbor can have a first relatively significant diameter at the interface with the endless screw, whereas, in order to have solar wheels 52 and 58 of the differential 40 with small diameter, the arbor 32 has a second diameter smaller than the first, at the differential 40.

Under the crystal 14, the watch includes a dial 60 arranged under the hands 16. According to one preferred embodiment of the invention, the dial is made up of two disks 62, 64 superimposed and made in polarized glass pierced in their centers so as to allow the hands 16 to pass.

A first glass 62 is fixed, for example by clipping, adhesion, welding, screwing or by being retained by a fastening ring, on a flange 66 included by the case.

A second glass 64 is fixed on a circular frame 68 mounted mobile in rotation around the center of the dial. This frame is arranged between the flange and a fitting circle 70, which each comprise, opposite each other, a ball path 72 between which the frame pivots. The second glass 64 is situated sufficiently far from the movement to make it possible to have small dials 74 to display different information, such as a small second hand, power reserve, lunar phase, etc . . . The frame 68 comprises, on its outer perimeter, a toothing 76 engaged with the endless screw 30. Thus, the pivoting of the screw 30 causes the frame 68, and therefore the second glass 64, to rotate.

More particularly, the reduction realized by the differential 40, on one hand, and the ratio between the toothings of the endless screw 30 and the frame 68, on the other hand, are determined such that, when the cover 18 goes from a first position in which it is closed on the crystal of the watch, to a second position in which it is open and abutting on the bridge 36 via the pivot-shank 24*a*, the second glass 64 turns by a predefined angle, the value of which may be, for example, 90° . Moreover, the two glasses 62 and 64 are arranged such that, when the cover is in its first position, the directions of polarization of the two glasses are parallel and, when the cover is in its second direction, they are perpendicular.

The cover therefore serves as control organ to modify the state of the dial. More particularly, when the cover 18 is closed, the two glasses 62 and 64 forming the dial do not allow light to pass and only the hands 16 are visible, behind the crystal 19 of the cover and that 14 of the watch, on a black background formed by the dial 60. When the cover 18 is open, the two glasses 62 and 64 forming the dial 60 allow at least some of the light to pass such that the particular indications displayed behind the dial or possible openings allowing the movement to appear, are visible through the dial.

Although it is preferred, the above embodiment is only one particular example illustrating the invention. The control organ could be realized more simply, for example by using a rotary bezel or a bolt mounted mobile in the middle of the case. Moreover, the rotation of the screw 30 can be brought about by a gear train in any location of the movement, for example to actuate a bolt mounted mobile at a small dial, like what was described above for the main dial. The rotational movement created by the cover and transmitted to the mobile frame can be reduced at the gear train, without a differential being necessary.

Moreover, it is possible to obtain, in different ways, a dial capable of assuming

- a first state in which, at least in a zone visible through the crystal of the watch and normally used to display information, it does not allow outside light to pass to the movement, and
- a second state in which, at least in that zone, it is passed through by the light coming from outside the watch up to the movement, while remaining positioned opposite the zone.

In fact, one of the aims of the invention is indeed to conceal or make visible information displayed under the dial, a decoration or a portion of the movement, situated on its upper face, i.e. on the side of the crystal, but without the dial opening or retracting. The movement remains continuously protected by the dial.

Thus, the dial could also be made up of two prisms, at least one being capable of moving perpendicularly in relation to the plane of the dial. The upper prism, i.e. that situated on the side of the crystal, has a colored face which reflects the light when the dial is in its first state and the two prisms are remote from each other. When the dial is in its second state, the first dial is brought into contact with the second prism and interlocks therewith. The incident light then crosses both prisms, without being reflected on the colored face, which makes it possible to allow the light to pass up to the movement or the display zone.

It is easy for those skilled in the art to mount a mobile prism, guided in several points and stressed by a spring in order to avoid any untimely movement. A cam actuated by a control organ pushes the prism while stressing the spring, so as to bring it into contact with the other prism. The control organ can be a cover or one of the other organs previously cited.

One could also imagine that the first and second glasses each have a regular alternation of identical portions of two types, the portions of the first type being polarized in a first direction and the portions of the second type being polarized in a second direction. One of the glasses is arranged in a frame mounted mobile in translation or in rotation. In the first case, the portions are strips, whereas in the second case, they are sectors. In the first case, the translation of the mobile glass can be obtained in different ways, in particular via a cover which can also be mobile in translation, like the cover of a pencil box. The cover could also pivot, like in the embodiment previously described, the translational movement of the frame being obtained via a cam, a spring organ ensuring the return of the frame to its initial position. In the second case, the rotation of the glass can be obtained similarly to what was mentioned above.

The mobile frame is arranged so as to move between a first position in which the portions of the first type of each of the glasses are arranged in staggered rows (the same is therefore true for the portions of the second type) such that the light passes through both glasses, and a second position in which the portions of the first type of a first glass are superimposed on the portions of the second type of the other glass (and vice versa), the directions of polarization of said portions being oriented such that, in this position, the light does not pass through both glasses.

Of course, in the case of a translational movement, the mobile glass must include a resulting opening for the passage of the hands.

The dial can also include an LCD-type cell known by those skilled in the art, including a layer of liquid crystal arranged between two electrodes and between two polarizers oriented at 90° . Thus, when the cell is not powered on, the incident light passes through the first polarizer, undergoes a 90° rotation through the layer of liquid crystal, passes through the second polarizer before being reflected and coming back out of the cell via the inverse path. When the cell is powered on, the liquid crystals align in the electrical field. The incident light polarized by the first polarizer does not undergo any rotation while passing through the liquid crystals and therefore cannot pass through the second polarizer. The cell therefore appears black.

Naturally, the timepiece must, in this embodiment, include an energy source connected to the cell. The control organ is preferably formed by the cover which actuates a mobile portion serving as contactor. When the cover is opened or closed, the cell is powered on or off. Advantageously, the cell can be dimensioned as desired so as to occupy only a determined zone of the dial.

Thus is proposed a timepiece proposing a modular display making it possible to display, only and very readably, the current time or, additionally, other functions, a decoration or a portion of the movement, without needing to form openings in the dial.

According to a second aspect of the invention, aiming to improve the device described in document EP 0 484 821 and to adapt it to a watch not including electrical energy source, one skilled in the art can provide that the watch includes a dial of the conventional type, arranged between the movement and the crystal, and pierced with an opening. A fitting dimensioned so as to be able to cover the opening is mounted mobile under the dial, between a first position in which it covers said opening and a second position in which it leaves it free. A cover similar to that described in the first embodiment above is arranged on the watch and drives an energy transmission system, kinematically connecting the cover to the fitting, like the mobile frame above. Thus, when the cover evolves between its first and second extreme positions, it drives the fitting instead of driving the mobile frame. In this way, when the cover is closed, the opening is covered by the fitting and a non-open dial is visible through the crystal of the cover. When the cover is open, the opening is free and allows a display of an additional function, a decoration or a portion of the movement to show.

The invention claimed is:

1. A timepiece comprising:

a case, a movement housed in the case, a crystal closing the case, a dial arranged between the movement and the crystal, said dial being capable of assuming a first state in which elements situated behind the dial in reference to the crystal are visible from the side of the crystal and a second state in which said elements are hidden, a mobile portion capable of moving between at least one first and at least one second positions corresponding respectively to the first and second states of the dial, and display organs arranged between the dial and the crystal, said timepiece also comprising a cover mounted mobile relative to the case and kinematically connected to said mobile portion to cause it to go from its first to its second positions and to cause the dial to go from its first to its second states.

2. The timepiece of claim 1, wherein said mobile portion is part of the dial and wherein the dial is positioned opposite at least one display zone situated between the movement and the crystal, and wherein, when the dial is in its first state, it does not allow light from the outside to enter at least in said zone, and wherein, when the dial is in its second state, it is passed through by the light coming from outside the watch toward the movement, at least in said zone.

3. The timepiece of claim 2, wherein the dial comprises a first polarized glass in a first direction and a second glass polarized in a second direction, one of the two glasses defining the mobile portion, said glasses being arranged such that, when the dial is in its first state, the directions of polarization are oriented perpendicularly and are parallel in the second state.

4. The timepiece of claim 3, wherein one of the glasses is mounted on a mobile frame kinematically connected to the cover.

5. The timepiece of claim 1, wherein said cover is capable of evolving between a first and a second extreme position, and wherein the first and second extreme positions of the cover correspond to the first and second states of the dial, respectively.

6. The timepiece of claim 2, wherein the dial includes a first prism situated on the side of the crystal of the watch and comprising a colored face and a second prism having a shape complementary to the first, at least one of said prisms defining the mobile portion so as to evolve between a first position defining the first state of the dial, in which the two prisms are distant from each other and the light coming from the outside is reflected on the colored face and sent back to the outside, and a second position defining the second state of the dial, in which the two prisms are in contact with each other, the light coming from the outside passing through them.

7. The timepiece of claim 1, also including an electrical energy source, wherein the dial includes an LCD-type cell, the dial being in its first state when said cell is powered on and in its second state when the cell is not powered on and wherein the mobile portion controls the powering on of the cell.

8. The timepiece of claim 1, wherein the dial is pierced with an opening, and wherein said mobile portion define defines a fitting dimensioned and arranged so as to be able to cover said opening.

9. The timepiece of claim 8, wherein the first and second extreme positions of the cover are defined by stops and correspond to the first and second positions of the fitting, respectively.

10. The timepiece of claim 3, wherein the mobile portion is kinematically connected to the cover by a reduction system.

11. The timepiece of claim 5, wherein the mobile portion is kinematically connected to the cover by a reduction system.

12. The timepiece of claim 10, wherein the reduction system is a differential.

13. The timepiece of claim 11, wherein the reduction system is a differential.

14. The timepiece of claim 10, wherein the cover and the frame are kinematically connected via an endless screw.

15. The timepiece of claim 11, wherein the cover and the frame are kinematically connected via an endless screw.

16. The timepiece of claim 2, wherein said cover is capable of evolving between a first and a second extreme position, and wherein the first and second extreme positions of the cover correspond to the first and second states of the dial, respectively.

17. The timepiece of claim 3, wherein said cover is capable of evolving between a first and a second extreme position, and wherein the first and second extreme positions of the cover correspond to the first and second states of the dial, respectively.

18. The timepiece of claim 4, wherein said cover is capable of evolving between a first and a second extreme position, and wherein the first and second extreme positions of the cover correspond to the first and second states of the dial, respectively.

19. The timepiece of claim 4, wherein the mobile portion is kinematically connected to the cover by a reduction system.

20. The timepiece of claim 8, wherein the mobile portion is kinematically connected to the cover by a reduction system.

21. The timepiece of claim 9, wherein the mobile portion is kinematically connected to the cover by a reduction system.

* * * * *